United States Patent [19]

Stewert

[11] Patent Number: 4,703,851

[45] Date of Patent: Nov. 3, 1987

[54] COMBINATION GOLD BAG AND INSERT

[76] Inventor: Robert Stewert, 2729 W. Victory B1-Suite #D, Burbank, Calif. 91505

[21] Appl. No.: 936,099

[22] Filed: Nov. 28, 1986

[51] Int. Cl.[4] ..... A63B 55/00

[52] U.S. Cl. ..... 206/315.6; 206/315.8

[58] Field of Search ..... 206/315.2, 315.3, 315.4, 206/315.5, 315.6, 315.7, 315.8

[56] References Cited

U.S. PATENT DOCUMENTS

| | | | |
|---|---|---|---|
| 1,726,245 | 8/1929 | Shelton | 206/315.4 |
| 2,007,709 | 7/1935 | Eppens | 206/315.3 |
| 2,325,474 | 7/1943 | Cart | 206/315.7 |
| 3,842,876 | 10/1974 | Cristelli | 206/315.4 |
| 4,245,684 | 1/1981 | Street et al. | 206/315.4 |
| 4,383,563 | 5/1983 | Kirchhoff, Jr. | 206/315.3 X |

FOREIGN PATENT DOCUMENTS

| | | | |
|---|---|---|---|
| 428118 | 6/1911 | France | 206/315.5 |
| 259794 | 10/1926 | United Kingdom | 206/315.6 |
| 490428 | 8/1938 | United Kingdom | 206/315.6 |
| 2130102 | 5/1984 | United Kingdom | 206/315.3 |

*Primary Examiner*—William Price

[57] ABSTRACT

A new improved design in rigidly constructed gold bags. A semi-circular two compartment bag with a flat side extending the length thereof for holding the bag stationary when on or against a hard flat surface. Secured thereon are two rubber bumpers that elevate the open top end of the bag when on a flat surface thereby presenting the golf clubs therein in a highly visable and accessible manner. The golf bag is designed to accommodate therein a new improved adjustable golf bag insert member that provides the means for containing golf clubs within individual compartments for protection, identification and accessibility. Furthermore, contained within the bag insert is a tubular storage compartment for holding golf accessories and a removable two comaprtment container for miscellaneous items with an easily accessible insulated compartment for hot or cold beverages. The bag insert is easily adjusted by hand to fit within any circular or semi-circular rigidly constructed golf bag. Tools are not required for installation or removal of the bag insert.

1 Claim, 10 Drawing Figures

COMBINATION GOLD BAG AND INSERT

BACKGROUND OF THE INVENTION

This invention relates to a new improved design in rigidly constructed golf bags. A semi-circular dual compartment bag, with a flat side extending the length thereof to keep it stationary when placed on or against a hard surface. Secured thereon are two rubber bumpers that elevate the open top end of the bag when on a flat surface thereby preventing damage to the club heads. Furthermore, the golf clubs are presented in a more visable and accessible manner.

A main object of this invention is to provide a novel compact lightweight golf bag and adjustable bag insert member that is simple to assemble and inexpensive to manufacture.

A further object of this invention is to provide an adjustable, easily assembled golf bag insert that can be adjusted by hand to fit the diameter and length of any rigidly constructed circular or semi-circular golf bag and thereby provide the means for containing golf clubs within individual compartments for easy identification and access. Furthermore, it provides the means therein for a tubular storage compartment for holding golf accessories and hot or cold beverages with an easy access thereto.

Further objects and advantages of this invention will become apparent from the discription, claims and accompanying drawings.

DETAILED DESCRIPTION OF THE PREFERRED EMBODIMENT

Figure 1:
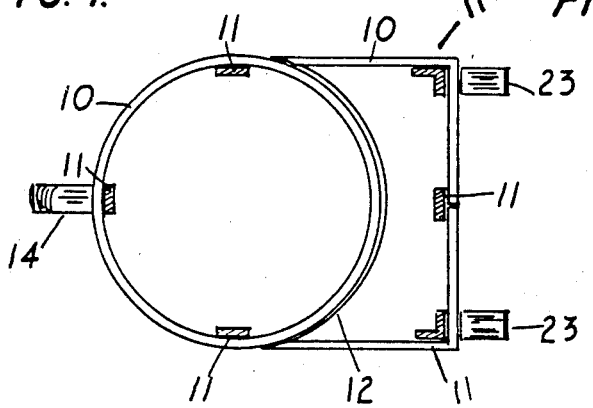
FIG. 1 is a plan view of the top and matching bottom metal frames of the golf bag.
Figure 3:
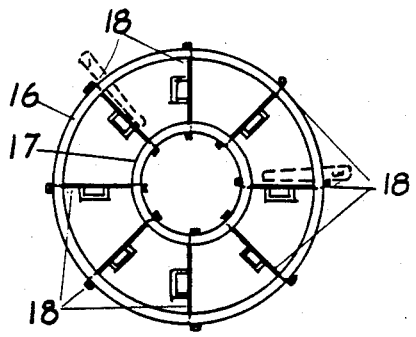
FIG. 3 is a plan view of the top and bottom matching adjustable golf bag insert sections.
Figure 2:
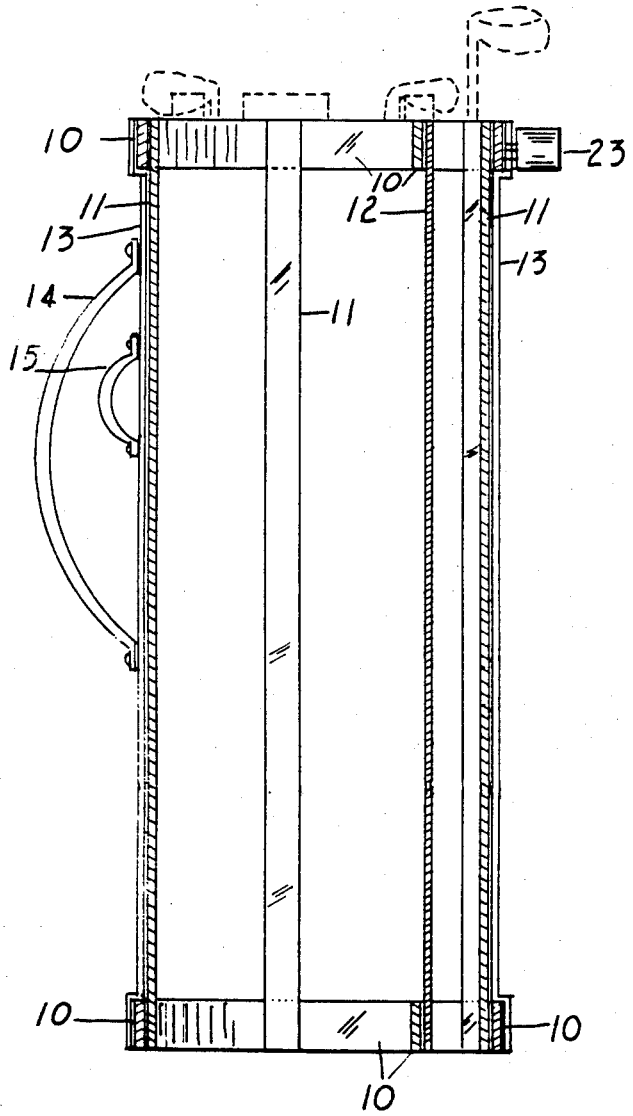
FIG. 2 is a cross section side view of FIG. 1.
Figure 4:
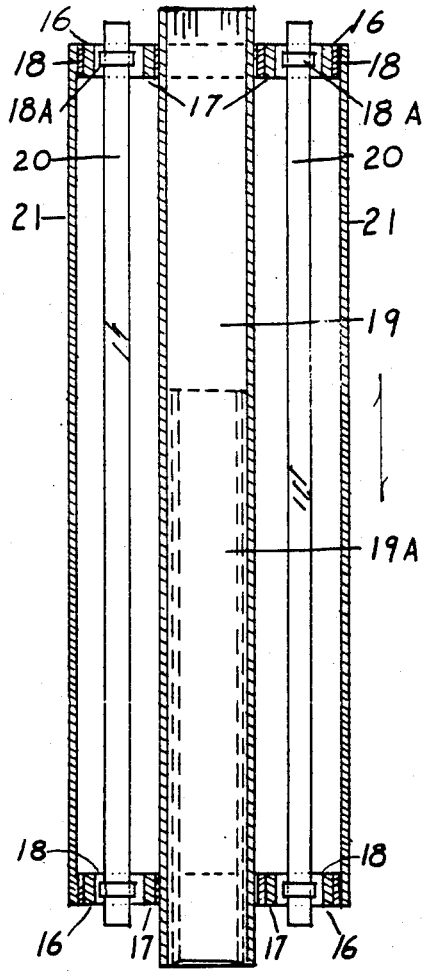
FIG. 4 is a cross section side view of FIG. 3.
Figure 5:
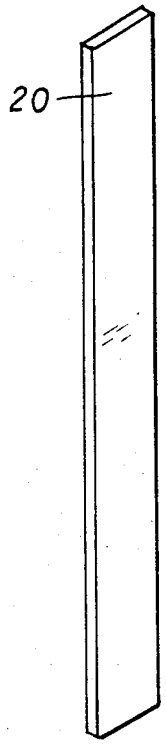
FIG. 5 is a perspective view of an elongated thin gauge plastic compartment divider.
Figure 6:
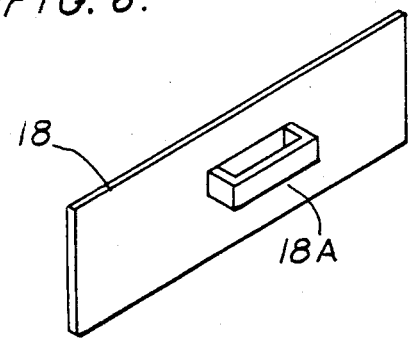
FIG. 6 is a perspective view of a club divider detailing the partially stamped out projection embodied therein.
Figure 7:
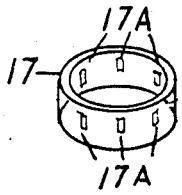
FIG. 7 is a perspective view of a formed circular one piece collar detailing a series of slots embodied therein.
Figure 8:
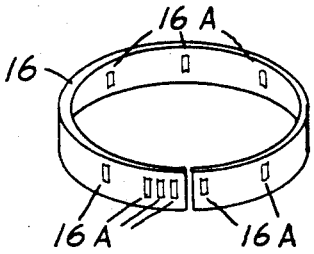
FIG. 8 is a perspective view of an adjustable formed collar detailing a series of slots embodied therein.
Figure 9:
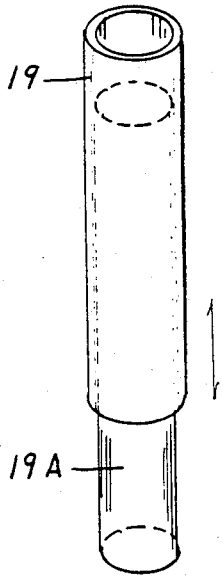
FIG. 9 is a perspective view of two sections of open and circular tubes.
Figure 10:
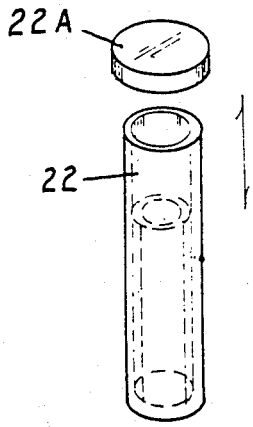
FIG. 10 is a perspective view of a two compartment container and cap.

Refer to the drawings; FIG. 1 is a view of the top and identical bottom welded metal frames 10 of the golf bag. The series of elongated metal framing members 11 are welded thereto forming a skelton framework of the golf bag. The two rubber bumpers 23 and the carrying strap 14 are bolted to the elongated framing members 11. The one piece interior partial bag cover 12 is of man made material and is secured to the top and bottom frames 10 of the golf bag with an adhesive. FIG. 2 is a cross section side view of the golf bag showing the identical top and bottom metal frames 10 welded to the series of elongated metal framing members 11 thereby forming the skelton metal framework of the golf bag. The exterior cover of the bag 13 is of man made material and is pulled on and over the completed metal framework and secured to the top and bottom frames 10 with an adhesive. The carrying handle 15 of the bag is bolted to the elongated metal framing member 11. Indicated within the bag are metal club heads supported by the top metal framework 10 of the bag and held within their individual compartments by the plastic club dividers. The The longer wood headed golf clubs are allowed to swing free. FIG. 3 is a view of identical top and bottom assembled sections of the adjustable gold bag insert member comprising an adjustable circular collar 16 of man made material. Embodied therein and encircling the collar 16 is a series stamped out vertical slots 16A. These slots match with the stamped out vertical slots 17A encircling the inner collar 17 that is made of man made material. These matching vertical slots are employed when securing the thin gauge metal club divider 18 between them in position for attaching the elongated plastic compartment dividers 20 thereto. FIG. 4 is a cross section side view of the elongated golf bag insert member in FIG. 3 comprising a circular rigid tube 19 positioned over a smaller diameter rigid bottom tube 19A thereby forming an adjustable rigid main support for attaching insert members. The assembled top section of the insert as in FIG. 3 is positioned over the top tube 19 and the identical bottom section of the insert is positioned over the bottom tube 19A. Both insert sections are held in place on the tubes by friction. The top tube 19 can be adjusted up or down on the bottom tube 19A thereby allowing the bag insert to be used with any length rigidly constructed circular or semi-circular golf bag. The cover 21 of the bag insert is made of an elastic fabric in a tubular shape open at both ends and fits over the assembled bag insert and is attached only to the top insert section 10 with an adhesive. FIG. 5 is a perspective side view of an elongated plastic compartment divider 20. The elongated plastic compartment dividers 20 are shown attached to the top and bottom sections of the insert by being inserted through the partially stamped out projections 18A embodied within the metal club divider 18. FIG. 6 is a perspective side view of a thin gauge metal club divider 18 detailing the partially stamped out projection 18A embodied therein. FIG. 7 is a perspective view of the smaller diameter insert collar 17 composed of man made material. Embodied therein encircling the collar 17 is a series of stamped out vertical slots 17A that become employed when securing the metal club divider 18 thereto. FIG. 8 is a perspective view of the larger adjustable insert collar 16 composed of man made material. Embodied therein and encircling the collar 16 is a series of stamped out vertical slots 16A that become employed when securing the metal club divider 18 thereto. Before assembling the top and bottom sections of the bag insert FIG. 3, determine the inside diameter of the golf bag and join the two collars 16 and 17 together by inserting the metal club dividers 18 through the matching vertical slots 16A and 17A embodied within the collars 16 and 17. Bend the ends of the metal club divider 18 that are projecting from the collars over until they conform to the curvatures of the collars locking the metal club divider 18 in position to accept the plastic compartment dividers 20. Follow the same proceedure for the matching bottom section of the insert. FIG. 9 is a perspective view of two sections of circular open end rigid plastic tubing. The top section 19 slides down over the smaller diameter bottom tube 19A and is held there by friction thereby reinforcing the two sections 19 and 19A making them adjustable to fit within any rigidly constructed circular or semi-circular golf bag. FIG. 10 is a perspective view of a removable two compartment container for holding golf accessories and an insulated compartment for hot or cold beverages. The container 22 has a slip fit top 22A and is carried within the top section of the circular plastic tube 19.

Now, due to the new design in the golf bag and allowances made therein for accommodating the new designed golf bag insert, it is hereby requested that the adjustable golf bag insert be included along with the golf bag as a part of this invention as herein described.

It is evident that additional golf club compartments can be added to the adjustable golf bag insert to accommodate more golf clubs.

I claim:

1. A new improved design in rigidly constructed golf bags comprising a multi compartment semi-circular bag having a frame with a flat side extending the length thereof for holding the bag stationary when on or against a flat surface, two rubber bumpers secured to said frame to elevate the top end of the bag when on a flat surface thereby presenting the clubs therein in a highly visible and accessible manner, an adjustable golf bag insert member with means for containing individual clubs in separate compartments for protection, identification and accessibility, and a tubular storage compartment forming the interior wall of the separate compartments and adapted to contain golf accessories and a removable container with an insulated compartment for transporting hot or cold beverages with easy access thereto.

* * * * *